US007158090B2

(12) United States Patent
Tang et al.

(10) Patent No.: US 7,158,090 B2
(45) Date of Patent: Jan. 2, 2007

(54) ANTENNA FOR A WIRELESS NETWORK

(75) Inventors: Chia-Lun Tang, Miaoli (TW); Shih-Huang Yeh, Yunlin (TW); Yung-Tao Liu, Kaohsiung (TW); Che-Wei Su, Changhua (TW); Kin-Lu Wong, Kaohsiung (TW)

(73) Assignee: Industrial Technology Research Institute, Hsinchu (TW)

( * ) Notice: Subject to any disclaimer, the term of this patent is extended or adjusted under 35 U.S.C. 154(b) by 198 days.

(21) Appl. No.: 10/871,573

(22) Filed: Jun. 21, 2004

(65) Prior Publication Data

US 2005/0280596 A1 Dec. 22, 2005

(51) Int. Cl.
*H01Q 1/48* (2006.01)
*H01Q 9/38* (2006.01)

(52) U.S. Cl. ..... 343/846; 343/829; 343/848

(58) Field of Classification Search ..... 343/829, 343/845–849

See application file for complete search history.

(56) References Cited

U.S. PATENT DOCUMENTS 4,644,361 A * 2/1987 Yokoyama ..... 343/700 MS
4,791,423 A * 12/1988 Yokoyama et al. .. 343/700 MS
4,821,040 A 4/1989 Johnson et al.
6,515,634 B1 2/2003 Desclos et al.
2001/0031647 A1* 10/2001 Scherzer et al. ..... 455/562
2002/0158807 A1 10/2002 Kuramoto
2003/0063031 A1* 4/2003 Wong et al. ..... 343/700 MS
2004/0130493 A1* 7/2004 Horita et al. ..... 343/702
2005/0212706 A1* 9/2005 Ying et al. ..... 343/702

FOREIGN PATENT DOCUMENTS

EP 1 111 718 B1 6/2001
JP 2001-185947 7/2001

OTHER PUBLICATIONS

Datasheets of DirectLink Series Antennas, Squint Omnidirectional Panel Antennas, Squint Dual-Band Ceiling Mount Antenna, and Special Purpose/Embedded Antennas, available at http://www.cushcraft.com, Oct. 11, 2004.

* cited by examiner

*Primary Examiner*—Tan Ho
*Assistant Examiner*—Leith Al-Nazer
(74) *Attorney, Agent, or Firm*—Finnegan, Henderson, Farabow, Garrett & Dunner, L.L.P.

(57) ABSTRACT

A data access system includes a plurality of access points and an antenna corresponding to one of the access points. The antenna includes a planar monopole, a vertical ground plane and a top horizontal ground plane. In one aspect, the top horizontal ground plane outwardly extends over the planar monopole for a distance that is generally between three-quarters to three-halves of the length of the planar monopole.

16 Claims, 6 Drawing Sheets x-z plane plane orthogonal to x-z plane at θ = 150°
(φ' = 0° and 180° are both in the x-z plane)

ANTENNA FOR A WIRELESS NETWORK

BACKGROUND OF THE INVENTION

1. Field of the Invention

The present invention generally relates to wireless networks and, more particularly, to an antenna in a wireless local area network.

2. Description of the Related Art

Wireless data access is widely used in contemporary work and home environments. Having a wireless local area network ("WLAN") with a plurality of antenna access points, for example, makes wireless data access available for any user having connectivity to those access points. Such antenna access points are deployed in indoor or outdoor environments. An example of an antenna for a WLAN access point can be a desktop antenna, or a wall antenna.

An example of a desktop antenna suitable to serve as a WLAN access point is shown in U.S. Patent Application Publication No. US2002/0158807. The desktop antenna shown includes a cylindrical design having a metallic reflector for monopole signal radiation. It would be desirable, however, to provide a desktop antenna that is smaller in size, less complex in design, and more efficient in vertical signal radiation.

There is thus a general need for a system and device overcoming at least the aforementioned shortcomings in the art. A particular need exists in the art for an antenna of an access point in a wireless system and network overcoming disadvantages with respect to design complexity, size, and vertical signal radiation.

BRIEF SUMMARY OF THE INVENTION

Accordingly, an embodiment of the present invention is directed to a system having at least one antenna access point that obviates one or more of the problems due to limitations and disadvantages of the related art.

To achieve these and other advantages, and in accordance with the purpose of the present invention as embodied and broadly described, there is provided a data access system comprising a plurality of access points, and an antenna corresponding to one of the access points comprising a planar monopole, a vertical ground plane and a top horizontal ground plane. In one aspect, the top horizontal ground plane and the monopole extend outwardly with respect to the vertical ground plane and the monopole is disposed below the top horizontal ground plane.

Further in accordance with the present invention, there is provided an antenna in a wireless system comprising a planar monopole, a vertical ground plane, and a top horizontal ground plane. In one aspect, the top horizontal ground plane outwardly extends over the planar monopole for a distance that is generally between three-quarters to three-halves of the length of the planar monopole.

Additional features and advantages of the present invention will be set forth in part in the description which follows, and in part will be obvious from the description, or may be learned by practice of the present invention. The features and advantages of the present invention will be realized and attained by means of the elements and combinations particularly pointed out in the henceforth appended claims.

It is to be understood that both the foregoing general description and the following detailed description are exemplary and explanatory only and are not restrictive of the present invention, as claimed.

The accompanying drawings, which are incorporated in and constitute a part of this specification, illustrate several embodiments of the present invention and together with the description, serve to explain the principles of the present invention.

DESCRIPTION OF THE EMBODIMENTS

Reference will now be made in detail to embodiments of the present invention, examples of which are illustrated in the accompanying drawings. Wherever possible, the same reference numbers will be used throughout the drawings to refer to the same or like parts.

Figure 1:
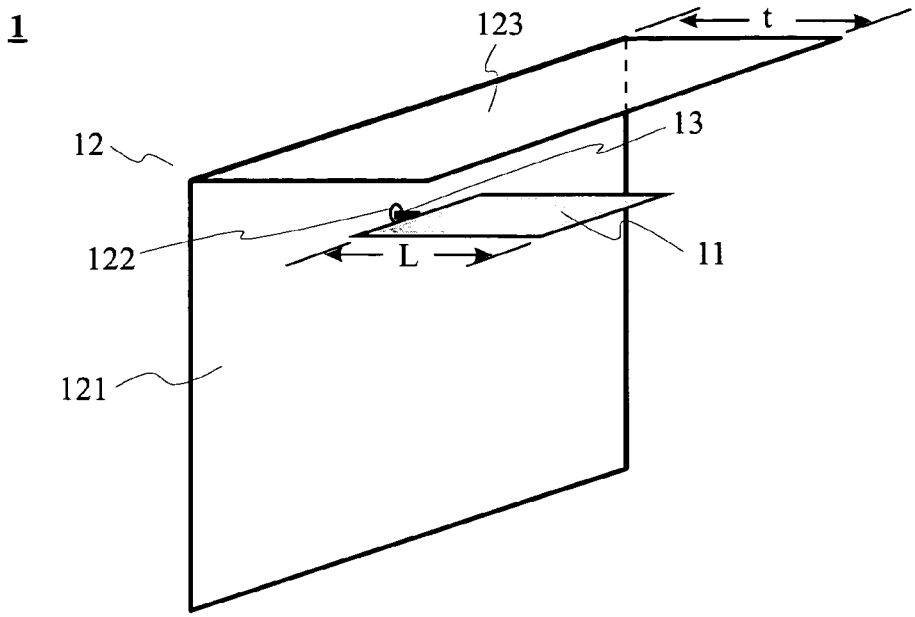
FIG. 1 is a schematic view of an example of an antenna in one of a plurality of access points in a wireless network consistent with the present invention.

FIG. 1 is a schematic view of an example of an antenna 1 in one of a plurality of access points in a wireless network consistent with the present invention. Antenna 1 includes a planar monopole 11, a vertical ground plane 121 and a top horizontal ground plane 123. In one aspect, generally vertical ground plane 121 and top horizontal ground plane are formed into an L shape, which is achieved by, for example, bending a generally planar metallic plate to form antenna ground 12. As a result, top horizontal ground plane 123 is generally perpendicular with respect to vertical ground plane 121.

Antenna 1 further includes a metallic conductor 13 having one end connected to planar monopole 11 and another end connected to a signal source (not shown in FIG. 1) through an via hole 122 which is on vertical ground plane 121 for providing and transmitting signals.

In one aspect, a length L of planar monopole 11, defined as a distance to which planar monopole 11 extends from vertical ground plane 121, is approximately equal to one quarter of the wavelength of an operating frequency of antenna 1. In another aspect, top horizontal ground plane 123 outwardly extends in a length direction of planar monopole 11 for a length t that is between three quarters (¾) to three halves (3/2) of the length L of planar monopole 11. These design parameters allow antenna 1 to advantageously achieve improved directivity in signal radiation. In yet another aspect, the distance between top horizontal ground plane 123 and planar monopole 11 is generally less than the length L of monopole 11. Such a design parameter advantageously allows antenna 1 to have improved antenna gain, better enabling it to serve as a on-wall antenna for an access point in a wireless network. The main beam radiation of an antenna consistent with the present invention advantageously achieves improved and broader transmission coverage and antenna efficiency, without additional mechanical manipulation on the wall mount support. An on-wall antenna consistent with the present invention enables a transmission beam in the downward direction that improves the orientation of signal radiation and efficiency. Specifically, by adjusting the distance between planar monopole 11 and top horizontal ground 123, and the length t of top horizontal ground plane 123, an antenna consistent with the present invention can more effectively provide a main radiation beam in the downward direction with a frequency gain at and over 8 dBi, where dBi are decibels referenced to an isotropic antenna.

Figure 2:
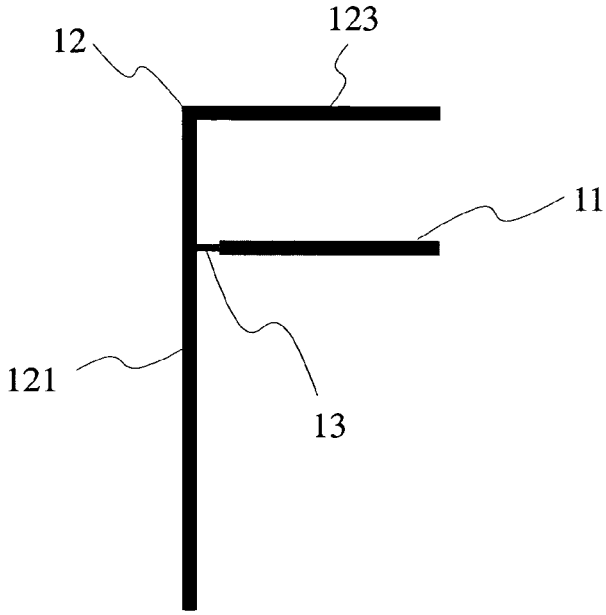
FIG. 2 is a side view of an example of an antenna in an access point in a wireless network consistent with the present invention.

FIG. 2 is a side view of an example of antenna 1 shown in FIG. 1. Examples, without limitation, of dimensions of planar monopole 11 are a length of about 35 mm, and a width of about 35 mm. Examples, without limitation, of dimensions of other elements of an antenna consistent with the present invention, are a distance between planar monopole 11 and top horizontal ground plane 123 of about 30 mm, vertical ground plane 121 having a length of about 120 mm, and a width of about 120 mm, and top horizontal ground plane 123 having a length of about 37 mm with a width of about 120 mm.

Figure 3:
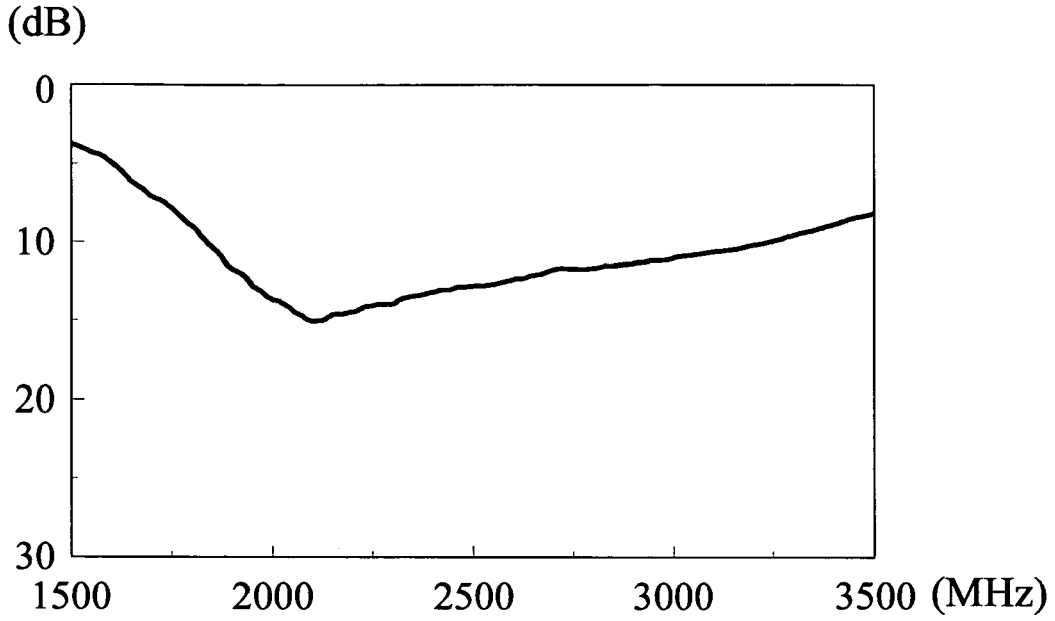
FIG. 3 is a graph illustrating the measured return loss according to an embodiment of the present invention.

FIG. 3 is a graph illustrating the measured return loss according to an embodiment of the present invention. The graphical representation in FIG. 3 is presented in an x-y coordinate system with the ordinate representing the return loss in decibel (dB) and the abscissa representing the frequency in megahertz (MHz). For a return loss of 10 dB or more, antenna 1 designed according to the exemplary dimensions set forth above is operable at 2.4 GHz band, or in a frequency range generally between 2400 MHz to 2484 MHz in a wireless network such as a WLAN.

Figures 4A, 4B:
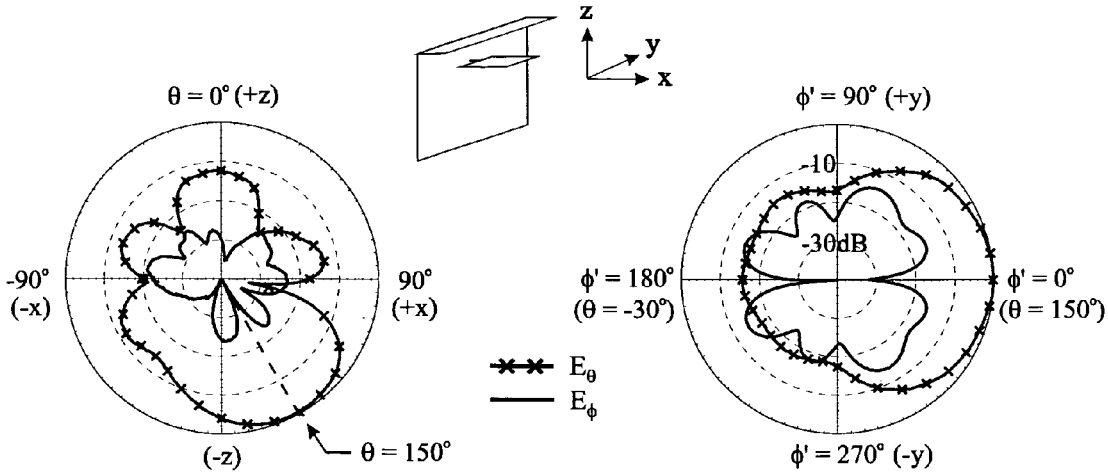
FIGS. 4A and 4B are graphs illustrating the measured antenna radiation patterns at 2442 MHz according to an embodiment of the present invention.

FIG. 4A is a graph illustrating the measured antenna radiation pattern in the x-z plane in a three-dimensional (x-y-z) coordinate system for an example of antenna 1 operating at 2442 MHz. The view in FIG. 4A is in a four-axes system with the +z axis where θ=0 degrees, +x axis where θ=90 degrees, −z axis where θ=180 degrees, and −x axis where θ=270 degrees. For a main radiation beam operable in the x-z plane at an angle θ=150 degrees, the 3-dB elevation beamwidth in the downtilt main beam is about 53 degrees.

FIG. 4B is a graph illustrating the measured antenna radiation pattern in the plane orthogonal to the x-z plane at θ=150 degrees for an example of antenna 1 operable at 2442 MHz. For a main radiation beam operable in the plane at an angle θ=150 degrees, the 3-dB beamwidth in the downtilt main beam is about 80 degrees.

Figure 5:
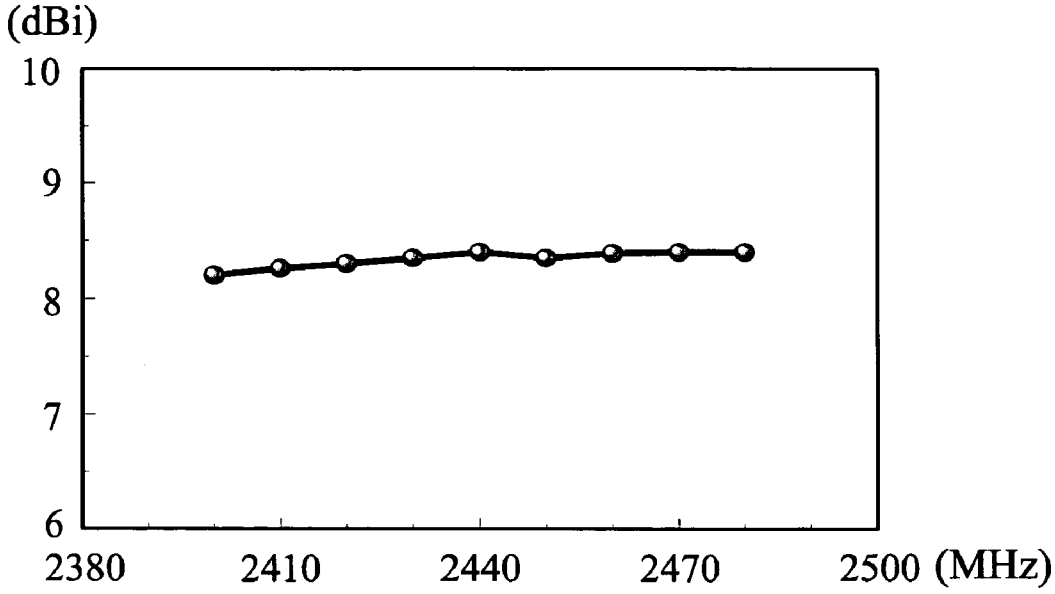
FIG. 5 is a graph illustrating the measured antenna gain at 2.4 GHz band according to an embodiment of the present invention.

FIG. 5 is a graph illustrating the measured antenna gain at 2.4 GHz band according to an embodiment of the present invention. The view in FIG. 5 is presented in a two-axes coordinate system where the abscissa represents frequency in MHz and the ordinate represents the frequency gain in dBi. In one aspect, antenna 1 can achieve antenna gain over 8 dBi, up to about 8.4 dBi for downtilt main beam radiation. Such a gain (e.g., between 8.1 to 8.4 dBi) is attainable for antenna 1 that is operable at 2.4 GHz in a wireless network such as a WLAN.

Figure 6A:
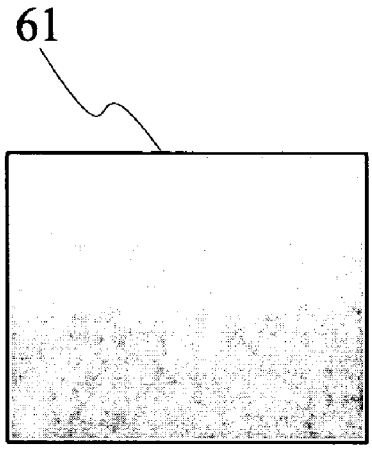
FIGS. 6A, 6B, 6C and 6D are schematic views of examples of a planar monopole for an access point antenna in a wireless network consistent with the present invention.
Figure 6B:
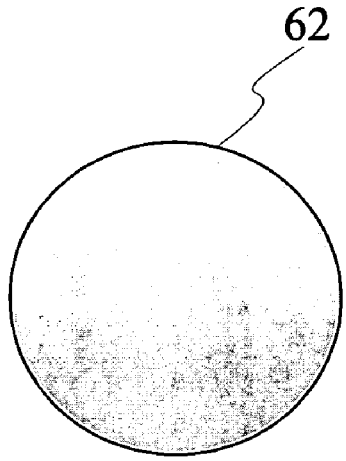
Figure 6C:
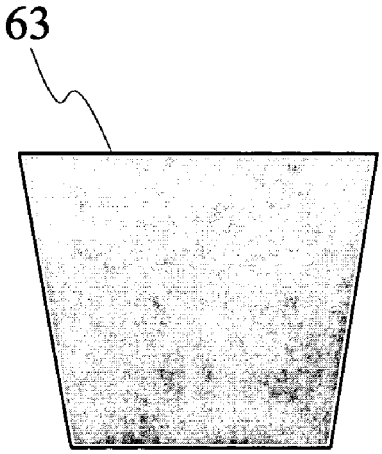
Figure 6D:
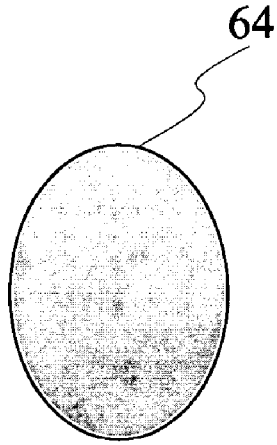

Although planar monopole 11 is shown in FIG. 1 to have a rectangular or square shape, it is to be understood that the shape of planar monopole 11 is not limited to a rectangle or a square. Without limitation, FIGS. 6A, 6B, 6C and 6D are schematic views of examples of planar monopoles that can be used in place of planar monopole 11 in antenna 1. Referring to FIG. 6A, an example of a planar monopole 61 is square-shaped. Referring to FIG. 6B, an example of a planar monopole 62 is round. Referring to FIG. 6C, an example of a planar monopole 63 is a polygon. Referring to FIG. 6D, an example of planar a monopole 64 is oval. When a planar monopole having a shape other than a rectangle or a square, as shown in FIGS. 6B, 6C, and 6D, is used, the length L of the planar monopole is defined as a distance to which the planar monopole extends from vertical ground plane 121.

Figure 7:
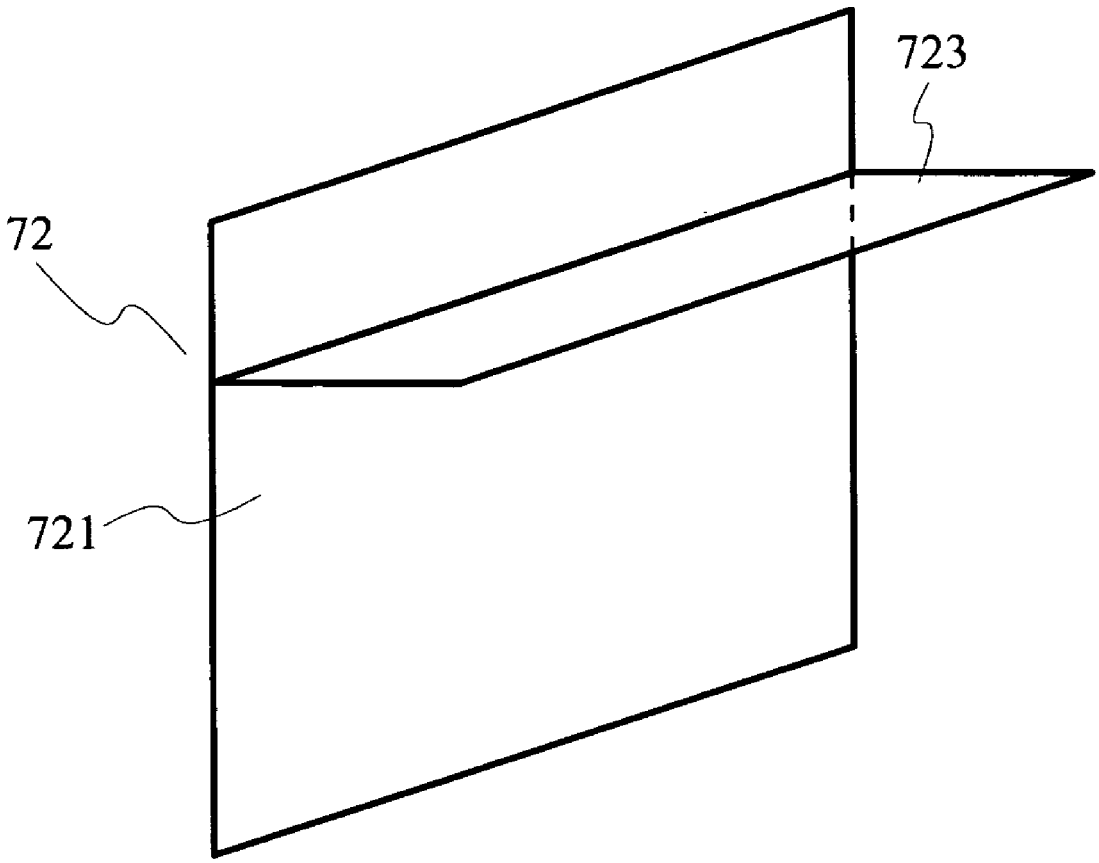
FIG. 7 is a schematic view of another example of antenna ground of an access point in a wireless network consistent with the present invention.

Further, in the description above, ground 12 of antenna 1 is formed by bending a single planar metallic plate, resulting in vertical ground plane 121 and top horizontal ground plane 123. It is to be understood that the antenna ground according to the present invention may also be formed by other means. For example, an antenna ground 72 consistent with an embodiment of the present invention as shown in FIG. 7 may be used in place of ground 12 in FIG. 1. As shown in FIG. 7, ground 72 includes a vertical ground plane 721 and a horizontal ground plane 723, wherein horizontal ground plane 723 is mounted onto vertical ground plane 721.

Other embodiments of the present invention will be apparent to those skilled in the art from consideration of the specification and practice of the present invention disclosed herein. It is intended that the specification and examples be considered as exemplary only, with a true scope and spirit of the present invention being indicated by the following claims.

We claim:

1. A data access system, comprising:

a plurality of access points; and an antenna corresponding to one of the access points, the antenna comprising:

a planar monopole, a vertical ground plane, and a top horizontal ground plane;

wherein the monopole is not connected to the vertical round plane or the top horizontal ground plane, the top horizontal ground plane and the monopole extend outwardly with respect to the vertical ground plane, a first distance by which the top horizontal ground plane extends from the vertical ground plane is shorter than a second distance by which the vertical ground plane extends from the top horizontal ground plane, and the monopole is disposed below the top horizontal ground plane.

2. The system of claim 1 wherein the top horizontal ground plane is generally perpendicular to the vertical ground plane.

3. The system of claim 1 wherein a length of the top horizontal ground plane outwardly extends over the planar monopole for a distance that is generally between three-quarters to three-halves of a length of the planar monopole, the length of the monopole being along a direction extending outwardly from the vertical ground plane.

4. The system of claim 1 wherein a distance between the top horizontal ground and the planar monopole is generally less than a length of the planar monopole, the length of the monopole being along a direction extending outwardly from the vertical ground plane.

5. The system of claim 1 wherein the planar monopole has a shape that is one of round, oval, square and polygon.

6. The system of claim 1 further comprising a metallic conductor having one end connected to the planar monopole and another end connected to the signal source.

7. The system of claim 1 further comprising a wireless local area network.

8. The system of claim 1 wherein the vertical ground plane and the top horizontal ground plane form an antenna ground with an L shape and is achieved by bending a generally planar metallic plate into the L shape.

9. An antenna in a wireless system, comprising a planar monopole;

a vertical ground plane; and a top horizontal ground plane;

wherein the monopole is not connected to the vertical ground plane or the top horizontal ground plane, and the top horizontal ground plane outwardly extends in a length direction of the planar monopole for a length that is generally between three-quarters to three-halves of the length of the planar monopole.

10. The antenna of claim 9, wherein the top horizontal ground plane is generally perpendicular to the vertical ground plane.

11. The antenna of claim 9, wherein a distance between the top horizontal ground plane and the planar monopole is generally less than the length of the planar monopole.

12. The antenna of claim 9, wherein the planar monopole has a shape that is one of round, oval, square and polygon.

13. The antenna of claim 9, further comprising a metallic conductor having one end connected to the planar monopole and another end connected to the signal source.

14. The antenna of claim 9, wherein the vertical ground plane and the horizontal ground plane are formed from a single planar metallic plate by bending that metallic plate.

15. The antenna of claim 9, wherein the horizontal ground plane is mounted onto the vertical ground plane.

16. The antenna of claim 9, wherein the length of the planar monopole is approximately equal to one quarter of the wavelength of an operating frequency of the antenna.

* * * * *

UNITED STATES PATENT AND TRADEMARK OFFICE

CERTIFICATE OF CORRECTION

PATENT NO. : 7,158,090 B2
APPLICATION NO. : 10/871573
DATED : January 2, 2007
INVENTOR(S) : Chia-Lun Tang et al.

It is certified that error appears in the above-identified patent and that said Letters Patent is hereby corrected as shown below:

Claim 1, column 4, line 40, "round" should read --ground--.

Signed and Sealed this

Tenth Day of April, 2007

JON W. DUDAS
*Director of the United States Patent and Trademark Office*